United States Patent [19]

Lindemann

[11] 4,330,293

[45] May 18, 1982

[54] DYEING OR PRINTING PROCESS

[75] Inventor: Wolfgang Lindemann, Inzlingen, Fed. Rep. of Germany

[73] Assignee: Sandoz Ltd., Basel, Switzerland

[21] Appl. No.: 167,189

[22] Filed: Jul. 9, 1980

Related U.S. Application Data

[63] Continuation-in-part of Ser. No. 1,478, Jan. 8, 1979, abandoned.

[30] Foreign Application Priority Data

Jan. 14, 1978 [DE] Fed. Rep. of Germany ..... 2801577

[51] Int. Cl.[3] ..... D06P 1/46; D06P 5/00

[52] U.S. Cl. ..... 8/495; 8/558; 8/499

[58] Field of Search ..... 8/495, 558, 499

[56] References Cited

U.S. PATENT DOCUMENTS

| | | | |
|---|---|---|---|
| 1,976,679 | 10/1934 | Fikentscher et al. | 8/558 |
| 3,090,762 | 5/1963 | Maeden et al. | 8/495 |
| 3,978,016 | 8/1976 | Perronin et al. | 8/495 |
| 4,036,587 | 7/1977 | Wolf et al. | 8/495 |
| 4,181,498 | 1/1980 | Koltai et al. | 8/558 |

FOREIGN PATENT DOCUMENTS

| | | | |
|---|---|---|---|
| 2557556 | 6/1977 | Fed. Rep. of Germany | 8/495 |
| 49-64826 | 12/1975 | Japan | 8/495 |

OTHER PUBLICATIONS

Clarke, An Introd. to Textile Printing, John Wiley & Sons, N.Y., 1975, pp. 18–19, 74–75.

Davidson et al., Water-Soluble Resins, Reinhold Book Corp., N.Y., 1962, pp. 154–157, 166–169.

*Primary Examiner*—Maria Parrish Tungol

*Attorney, Agent, or Firm*—Gerald D. Sharkin; Richard E. Vila; Thomas C. Doyle

[57] ABSTRACT

The present invention relates to a process for dyeing or printing a flat form textile substrate which comprises applying onto the substrate an aqueous dyeing or printing liquor having a viscosity below 500 cps and comprising a synthetic thickener precursor which contains carboxylic acid groups in free acid form, the substrate having been pretreated by depositing thereon a solution of a basic compound, the dyeing or printing liquor being converted on contact with the pretreated substrate into a gel having a viscosity from 3,000 to 60,000 cps.

21 Claims, No Drawings

DYEING OR PRINTING PROCESS

The present application is a continuation-in-part of application Ser. No. 001,478 filed on Jan. 8, 1979 and now abandoned.

The present invention relates to dyeing or printing flat form textile substrates with a dyeing or printing liquor having a low viscosity.

It is known to incorporate a synthetic thickener into a dyeing liquor or printing paste to hinder the running of the liquor or paste on application onto the substrate. In cases where a fine and accurate design is desired, application systems using small diameter, e.g. nozzles or jets are employed and the use of a thickened paste or liquor may lead to obstructions and cleaning problems, hindering thereby the continuous dyeing or printing operation.

It has now been found that it is possible to avoid these difficulties, particularly in the case of jet or spray-printing, by applying a fluid dyeing liquor containing a synthetic thickener precursor on a substrate impregnated with a solution causing the gelatinization of the dyeing liquor on contact with the substrate.

More particularly, the invention provides a process for dyeing or printing a flat form textile substrate which comprises applying onto the substrate an aqueous dyeing or printing liquor having a viscosity below 500 cps and comprising a polymeric synthetic thickener precursor which contains carboxylic acid groups in free acid form, the substrate having been pretreated by depositing thereon a solution of a basic compound selected from ammonia, an alkali metal hydroxide, an amine and an alkali metal salt, the dyeing or printing liquor being converted on contact with the pretreated substrate into a gel having a viscosity from 3,000 to 60,000 cps.

The term "gel" refers to a thickening which is distinct from a coagulation. A gel is defined as being a fluid dispersion of a colloid in a liquid phase, whereas a coagulation is a precipitation of colloids in a soft mass. It is believed that an aqueous solution of a synthetic thickener (i.e. in form of a monovalent salt) is a gel. In the presence of polyvalent cations, such a thickening coagulates.

By the term "flat form textile substrates" are to be understood substrates having large continuous surface area, e.g. fabrics, carpets, felts and velvets.

The synthetic thickener precursors used in the present invention are polymeric polycarboxylic acids which are transformed into a thickening agent when they are at least partially neutralized, i.e. converted into its salt form, i.e. the viscosity of an aqueous solution or optionally an aqueous colloidal solution of such a polycarboxylic acid increases to a maximum when the polycarboxylic acid is in the neutralized or salt form. These precursors are generally mixtures of linear or crosslinked chain polymers varying in their molecular weight and containing carboxylic acid groups. Examples of suitable polycarboxylic acids include homopolymers of acrylic acid or methacrylic acid and copolymers of acrylic acid, methacrylic acid or maleic anhydride with one or more further ethylenically unsaturated monomers. The copolymers of acrylic acid or methacrylic acid with ethylenically unsaturated comonomers may contain up to 50% by weight of the latter monomers, preferably from 1 to 20% by weight. As examples of ethylenically unsaturated monomers, copolymerizable with acrylic acid or methacrylic acid may be given ethylene, propylene, (meth)acrylic acid esters or (meth)acrylamide.

Suitable copolymers of maleic anhydride are those obtained by copolymerization of maleic anhydride with an ethylenically unsaturated monomer for example ethylene, propylene, isobutylene or vinyl ethers, preferably ethylene. Preferred copolymers of maleic anhydride contain the maleic anhydride and the other copolymerizable monomer in a substantially equimolar ratio. As will be appreciated, the copolymers of maleic anhydride must be at least partially hydrolised to yield carboxylic acid groups. Preferred synthetic thickener precursors are polyacrylic acids having a molecular weight from 500,000 to 6,000,000, preferably from 1,000,000 to 4,000,000. Such compounds are commercially available.

The amount of synthetic thickener precursor present in the dyeing or printing liquor may vary within a large range depending essentially on the final viscosity of the liquor to be produced on the substrate on contact with the basic compound. The aqueous dyeing or printing liquor generally contains, per liter, from 0.1 to 80 g, preferably from 1 to 10 g of the synthetic thickener precursor.

The preferred alkali metal hydroxide is sodium hydroxide and preferred alkali metal salts are sodium or potassium carbonate or bicarbonate. Suitable amines are mono-, di- or triethanolamine. Preferred basic compounds are sodium carbonate and triethanolamine.

When the synthetic thickener precursor comes into contact with the basic compound, the former is immediately converted into a thickening agent and the dyeing or printing liquor gelatinizes. Thus, the amount of basic compound to be applied onto the substrate or discrete areas thereof depends on the amount of synthetic thickener precursor present in the dyeing or printing liquor and on the final viscosity of the liquor to be produced on the substrate. The viscosity variations of the synthetic thickener precursor as a function of the pH may be assessed by known methods. The quantity of basic compound necessary to convert the synthetic thickener precursor into its salt form may also be assessed according to known methods. Normally, full gelatinization of the thickener is preferred and therefore the basic compound is generally employed in a stoichiometric molar ratio to the free acid groups in the synthetic thickener precursor.

The basic compound may be deposited on the substrate by any convenient method, for example from a liquor, e.g. by padding, slop-padding or spraying, including electrostatic spraying, or in paste form, e.g. by printing. It may of course be applied along with a dyestuff e.g. in a dye liquor or printing paste, the dye, for example, serving to impart to the substrate an overall ground colour for the pattern or design later to be applied.

The nature, e.g. class, of dyestuff employed in the dyeing or printing liquor, as will be appreciated, is chosen depending on the chemical nature of the textile substrate to be dyed or printed. Thus, where the substrate comprises or consists of natural or synthetic polyamide, the dye used will generally be an anionic dye, a reactive dye or a disperse dye. Where the substrate comprises or consists of acid modified polyacrylonitrile, the dye will generally be a metal complex dye or a disperse dye; where basic modified polypropylene, the dye will generally be an anionic or metal complex dye; where nickel modified polypropylene, the dye will generally be a disperse dye; where polyester, the dye will generally be a disperse dye; where basic modified polyester, the dye will generally be an anionic dye; and where cotton, the dye will generally be a direct or reactive dye. As will be appreciated, two or more classes of dyestuff may be comprised in the dyeing or printing liquor where the substrate comprises fibres dyeable with two or more different classes of dye, e.g. a disperse dye may be used together with an anionic dye where the substrate is of natural or synthetic polyamide. Two or more different classes of dyes may likewise be used when dyeing fibre blends.

It is known that synthetic thickeners and their precursors are sensitive to electrolytes, i.e. the presence of an electrolyte causes a decrease in viscosity. However, this sensitivity is variable, depending on the synthetic thickener used. In the case where a synthetic thickener relatively sensitive to electrolytes is formed, it is preferable to employ dyestuffs free of electrolytes, e.g. standardising salts and salts employed in salting out the dyestuff during production.

The dyeing or printing liquor according to the invention may contain the usual additives in addition to the dyestuff and the synthetic thickener precursor, the choice of additives depending on the nature of the substrate etc. When dyeing or printing a carpet, suitable additives are e.g. non-ionic anti-foaming agents. As the gelatinization of the synthetic thickener on the pretreated substrate is hindered by the presence of an electrolyte, the dyeing or printing liquor according to the invention should be free from any dyeing or printing assistant or additive which is an electrolyte. In this respect, the use of hard water should also be avoided. In the case where the presence of an electrolyte in the dyeing or printing liquor cannot be avoided, e.g. when the dyestuff is an acid dyestuff, it will be necessary to use more synthetic thickener precursor and basic compound than the amount used in absence of electrolytes in order to obtain the desired final viscosity. These amounts may be assessed according to known methods.

The initial low viscosity of the dyeing or printing liquor is adjusted by the proper selection of the synthetic thickener precursor and, optionally, by the addition of a non-ionic natural thickener. The initial viscosity is preferably up to 200 cps. The final viscosity of the dyeing or printing liquor on the substrate is preferably from 3,000 to 10,000 cps.

The rapid viscosity increase obtained on the substrate prevents lateral migration of the dyestuff and helps to give sharply outlined patterns or designs. Also the following undesirable effects are kept to a minimum: the so-called chromatography effect, i.e. the differences in migration behaviour when a mixture of dyestuffs is used, and the so-called frost effect in which the fibre tips are considerably less strongly dyed than the background due to a vertical migration of the dyestuffs.

The aqueous dyeing or printing liquor of the invention may be applied to the substrate in conventional manner, e.g. over the whole surface thereof or over discrete areas thereof to obtain the desired pattern, the pretreatment of the textile substrate having been carried out correspondingly over the whole surface or over discrete areas. In order to avoid the contamination of the dyeing or printing liquor containing the synthetic thickener precursor by the basic compound, the dyeing or printing liquor is preferably applied using a contact-free technique, e.g. spray (e.g. "militron" and "chromotronic" technique) and drop (e.g. "tak" and "randocolor" technique).

After carrying out the process of the invention, completion of dyeing or printing, e.g. involving fixation, washing and drying steps, takes place in known manner. If necessary, the dyed or printed substrate can be dried before fixation. Fixation of the dyestuffs can be effected by treatment with saturated or superheated steam or with hot air or, in the case of dyeings, by the cold retention process.

The dyeings and printings obtained according to the process of the invention, exhibit an improved brilliance and a deeper intensity as compared with dyeings using the same dyestuff under similar dyeing conditions by the hitherto known processes. As stated above, the fibre tips of carpets dyed or printed according to the invention do not display the undesirable frost effect but are intensively dyed. This provides the good brilliance effect which is particularly important for carpets.

The process of the invention is particularly suitable for dyeing or printing carpets, more particularly in a continuous contact-free process, e.g. spray-printing. Fine and elaborate dyeings and printings can thus be obtained.

The invention is further illustrated by the following Examples, in which all parts and percentages are by weight and all temperatures in degrees centigrade. The viscosity values are as measured on a Haacke laboratory Tester VT O2.

EXAMPLE 1

A tufted velvet fabric of polyamide (Du Pont) is impregnated on a twin roller dye padder with an alkaline liquor (I) consisting of

| | |
|---|---|
| 25 | parts of commercially available triethanolamine, and |
| 975 | parts of demineralized water |
| 1,000 | parts |

at a 100% pick-up.

The thus treated substrate is then printed using a jet-patterning apparatus with the following dye liquors II, III, IV and V at a 300% pick-up.

Liquor II

| | |
|---|---|
| 0,5 | part of a dyestuff mixture consisting of dyestuff C.I. Acid Blue 52, C.I. Acid Orange 127 and C.I. Acid Red 299 in a weight ratio of 1:3:1 |
| 300,0 | parts of Carbopol 846, 1% (commercially available synthetic thickener based on carboxylated acrylic polymer, in the free acid form), and |
| 699,5 | parts of demineralized water |
| 1,000 | parts |

This liquor has a viscosity $<30$ cps.

Liquor III

| | |
|---|---|
| 2 | parts of dyestuff C.I. Acid Blue 127:1, |
| 2 | parts of butyldiglycol, |
| 300 | parts of Carbopol 846,1%, and |
| 696 | parts of demineralized water |
| 1,000 | parts |

The viscosity of this liquor is less than 30 cps.

Liquor IV

| | |
|---|---|
| 4 | parts of dyestuff C.I. Acid Red 299, |
| 4 | parts of butyldiglycol, |
| 300 | parts of Carbopol 846,1%, and |
| 692 | parts of demineralized water |
| 1,000 | parts |

This liquor has a viscosity <30 cps.

Liquor V

| | |
|---|---|
| 1 | part of dyestuff C.I. Direct Yellow 132, |
| 500 | parts of Carbopol 846,1%, and |
| 499 | parts of demineralized water |
| 1,000 | parts |

This liquor has a viscosity <30 cps.

The resulting substrate is then treated for 6 minutes with saturated steam at 102° and subsequently washed with cold water. A brown, blue, red and yellow patterned substrate is obtained with notably sharp outlines.

EXAMPLE 2

By following the procedure of Example 1 but employing the following alkaline liquor consisting of

| | |
|---|---|
| 12 | parts of an ammonia solution 25%, and |
| 988 | parts of demineralized water |
| 1,000 | parts |

instead of the liquor I, similar good results are obtained.

EXAMPLE 3

By following the procedure of Example 1 but employing, instead of the liquor I, the following alkaline liquor consisting of

| | |
|---|---|
| 12 | parts of sodium carbonate, and |
| 988 | parts of demineralized water |
| 1,000 | parts |

a similar pattern of good quality is obtained.

EXAMPLE 4

A velvet carpet of polyester (Trevira 813) is printed according the procedure of Example 1, but using following liquors.

The alkaline liquor used for the pre-treatment consists of

| | |
|---|---|
| 20 | parts of triethanolamine, and |
| 980 | parts of demineralized water |
| 1,000 | parts |

The printing liquors have the following composition:

| | | |
|---|---|---|
| (a) | 2 | parts of dyestuffs C.I. Disperse Yellow 23, |
| | 698 | parts of demineralized water, and |
| | 300 | parts of Carbopol 846,1% (thickening agent of Example 1) |
| | 1,000 | parts |
| (b) | 4 | parts of a dyestuffs mixture containing dyestuff C.I. Disperse Red 167 dyestuff C.I. Disperse Blue 73, and dyestuff C.I. Disperse Orange 30 in a weight ratio of 1:1.5:3.5, |
| | 696 | parts of demineralized water, and |
| | 300 | parts of Carbopol 846,1% |
| | 1,000 | parts |
| (c) | 1 | part of dyestuff C.I. Disperse Red 53, |
| | 699 | parts of demineralized water, and |
| | 300 | parts of Carbopol 846,1% |
| | 1,000 | parts |
| (d) | 3 | parts of dyestuff C.I. Disperse Blue 56 |
| | 697 | parts of demineralized water, and |
| | 300 | parts of Carbopol 846,1% |
| | 1,000 | parts |

Each printing liquor (a) to (d) displays a viscosity inferior to 30 cps.

A print with notably sharp outlines is obtained.

What is claimed is:

1. A process for dyeing or printing a flat form textile substrate which comprises spraying or dropping onto the substrate an aqueous dyeing or printing liquor having a viscosity below 500 cps and comprising a polymeric synthetic thickener precursor which contains carboxylic acid groups in free acid form, the substrate having been pretreated by depositing thereon a gel forming effective amount of a solution of a basic compound selected from ammonia, an alkali metal hydroxide, an amine, an alkali metal carbonate and an alkali metal bicarbonate, the dyeing or printing liquor being converted on contact with said basic compound on the pretreated substrate into a gel having viscosity from 3,000 to 60,000 cps.

2. A process according to claim 1, wherein the polymeric synthetic thickener precursor is selected from a polyacrylic acid, a polymethacrylic acid and an ethylene/maleic anhydride copolymer.

3. A process accordings to claim 1, wherein the polymeric synthetic thickener precursor is a polyacrylic acid having a molecular weight from 500,000 to 6,000,000.

4. A process according to claim 1, wherein the aqueous dyeing or printing liquor contains, per liter, from 0.1 to 80 g of the synthetic thickener precursor.

5. A process according to claim 1, wherein the basic compound is applied onto the substrate in a stoichiometric molar ratio to the free acid groups in the synthetic thickener precursor.

6. A process according to claim 1, wherein the final viscosity of the dyeing or printing liquor after application onto the substrate is from 3,000 to 10,000 cps.

7. A process according to claim 1, wherein the basic compound is sodium hydroxide, ammonia, monoethanolamine, diethanolamine, triethanolamine, sodium carbonate or sodium bicarbonate.

8. A process according to claim 7, wherein the basic compound is triethanolamine.

9. A process according to claim 1 which includes the step of depositing on the substrate the solution of the basic compound.

10. A process according to claim 1 wherein the alkali metal carbonate or bicarbonate is sodium or potassium carbonate or bicarbonate.

11. A process for dyeing or printing a flat form textile substrate which comprises spraying onto the substrate an aqueous dyeing or printing liquor having a viscosity below 500 cps and comprising a polymeric synthetic thickener precursor which contains carboxylic acid groups in free acid form, the substrate having been pretreated by depositing thereon a gel forming-effective amount of a solution of a basic compound selected from ammonia, an alkali metal hydroxide, an amine, an alkali metal carbonate and an alkali metal bicarbonate, the dyeing or printing liquor being converted on contact with said basic compound on the pretreated substrate into a gel having a viscosity from 3,000 to 60,000 cps.

12. A process for dyeing or printing a flat form textile substrate which comprises applying onto the substrate an aqueous dyeing or printing liquor having a viscosity below 200 cps and comprising a polymeric synthetic thickener precursor which contains carboxylic acid groups in free acid form, the substrate having been pretreated by depositing thereon a gel forming-effective amount of a solution of a basic compound selected from ammonia, an alkali metal hydroxide, an amine, an alkali metal carbonate and an alkali metal bicarbonate, the dyeing or printing liquor being converted on contact with said basic compound on the pretreated substrate into a gel having a viscosity from 3,000 to 60,000 cps.

13. A process according to claim 12 wherein the dyeing or printing liquor is applied by spraying.

14. A process according to claim 12 wherein the amount of basic compound on the substrate is an amount effective to increase the viscosity of the dyeing or printing liquor to 3,000 to 10,000 cps.

15. A process according to claim 14 which includes the step of depositing on the substrate the solution of the basic compound.

16. A process according to claim 15 wherein the polymeric synthetic thickener precursor is selected from a polyacrylic acid, a polymethacrylic acid and an ethylene/maleic anhydride copolymer and the basic compound is sodium hydroxide, ammonia, monoethanolamine, diethanolamine, triethanolamine, sodium carbonate or sodium bicarbonate.

17. A process according to claim 14 wherein the polymeric synthetic thickener precursor is selected from a polyacrylic acid, a polymethacrylic acid and an ethylene/maleic anhydride copolymer and the basic compound is sodium hydroxide, ammonia, monoethanolamine, diethanolamine, triethanolamine, sodium carbonate or sodium bicarbonate.

18. A process according to claim 17 wherein the dyeing or printing liquor is applied by spraying.

19. A process according to claim 12 wherein the dyeing or printing liquor is applied by spraying.

20. A process according to any of claims 1, 5, 8, 11 or 12 wherein the polymeric synthetic thickener precursor is selected from the group consisting of homopolymers of acrylic acid and methacrylic acid, copolymers of acrylic acid or methacrylic acid with up to 50% by weight of ethylene, propylene, an acrylic acid ester, a methacrylic acid ester, acrylamide or methacrylamide and copolymers of maleic anhydride with ethylene, propylene, isobutylene or a vinyl ether.

21. A process according to claim 20 wherein the aqueous dyeing or printing liquor contains 1 to 10 grams of synthetic thickener precursor per liter.

* * * * *